US005967825A

United States Patent [19]

Lima et al.

[11] Patent Number: 5,967,825

[45] Date of Patent: Oct. 19, 1999

[54] INTEGRAL ACTUATOR FOR A PRINTED CIRCUIT BOARD

[75] Inventors: David J. Lima, Los Altos; Mark J. Glusker, San Mateo; Michael A. Koken, Sunnyvale; Sung Kim, Palo Alto; Bruno Lucien Andre Richet, Redwood City, all of Calif.

[73] Assignee: Silicon Graphics, Inc., Mountain View, Calif.

[21] Appl. No.: 08/911,909

[22] Filed: Aug. 15, 1997

[51] Int. Cl.[6] ..... H01R 13/62

[52] U.S. Cl. ..... 439/372

[58] Field of Search ..... 439/159, 310, 439/153, 327, 372

[56] References Cited

U.S. PATENT DOCUMENTS

| | | | |
|---|---|---|---|
| Re. 35,938 | 10/1998 | O'Brien et al. | 439/160 |
| 5,224,016 | 6/1993 | Weisman et al. | 439/327 |
| 5,398,164 | 3/1995 | Goodman et al. | 439/153 |
| 5,675,475 | 10/1997 | Mazura et al. | 439/157 |
| 5,730,605 | 3/1998 | Gluster et al. | 439/67 |
| 5,848,906 | 12/1998 | Gusker et al. | 439/157 |

OTHER PUBLICATIONS

Kenneth Mason Publications Ltd, Latch Retention System for Zip Connectors, Feb. 1988.

*Primary Examiner*—Neil Abrams
*Assistant Examiner*—J. F. Duverne
*Attorney, Agent, or Firm*—Sterne, Kessler, Goldstein & Fox P.L.L.C.

[57] ABSTRACT

An integral actuator mounts to a printed circuit board and effects connection of the printed circuit board to an external device, such as a motherboard, from a remote position outside of the printed circuit board. The actuator includes a platform affixed to the printed circuit board, a plunger (with a handle) slidably attached to the platform, and a cam slidably and rotatably attached to the plunger. When a customer pushes the plunger handle (which extends outside the bulkhead assembly of the printed circuit board) the plunger slides inward, causing the cam to rotate. This rotation of the cam pushes connector pins into the motherboard (for an electrical connection) and attaches the printed circuit board to the motherboard. The printed circuit board can also be unattached from the motherboard if the customer pulls the plunger handle, where the cam and the plunger move in a reversed manner. In a preferred embodiment, an actuator structure is provided that attaches to the back of the printed circuit board. In an alternative embodiment, an actuator structure is provided that attaches to the front of the printed circuit board, suspended over the circuit components.

30 Claims, 5 Drawing Sheets

INTEGRAL ACTUATOR FOR A PRINTED CIRCUIT BOARD

CROSS-REFERENCE TO RELATED APPLICATIONS

The following patents of common assignee may contain some common disclosure with the present application:

U.S. Pat. No. 5,730,605, issued Mar. 24, 1998, issued from U.S. patent application Ser. No. 08/713,283, filed Sep. 13, 1996.

U.S. Pat. No. 5,848,906, issued Dec. 15, 1998, issued from U.S. patent application Ser. No. 08/796,302, filed Feb. 7, 1997.

The above-listed applications are incorporated herein by reference in their entireties.

BACKGROUND OF THE INVENTION

1. Field of the Invention

The present invention relates generally to the field of actuators for an electronic device, and more specifically to an integral actuator for connecting a printed circuit board to an external circuit board.

2. Related Art

Traditional mechanisms for providing a physical and electrical connection between a printed circuit board and a motherboard use standard connectors, such as card edge connectors or pin-in-socket connectors. For the electrical connection, the printed circuit board connectors slide into corresponding connector receptacles in the motherboard. For the physical connection, there is a tight fit between the housing of the connector in the printed circuit board and the slot structure of the connector receptacle on the motherboard.

These systems have had numerous problems. One problem is the occurrence of signal delay caused by impedance mismatch between the printed circuit board and the connector, which causes overlapped and lost signals. To overcome the problem, more recent systems employ a compression connector that incorporates a flex circuit. Arrays of contact pads on the compression connector are pressed against corresponding contact pads on the motherboard. Mounting screws are used to secure the compression connector to the printed circuit board. However, the use of mounting screws is disadvantageous. For the mounting screws to be accessible to a customer installing the printed circuit board, the mounting screws must typically have lengths equal to the entire length of the circuit board. This is because the customer accesses the printed circuit board at the opposite end from where the board mounts to the motherboard. Typical mounting screw lengths are ten inches or longer. The mounting screws take up precious room on the printed circuit board, room that could be used for circuit components. Even if the mounting screws are mounted at the edges of the board, to reduce the room they waste, it is still a chore for a customer to screw in these long screws.

Because the mounting screws are typically made of metal, they provide additional problems. They can act as antennas, radiating electromagnetic energy through the board bulkhead (which is the customer interface) and outside of the board. They can also capture static electricity from customers, and pass it onto the circuit components.

Recent advances have attempted to combine flex based compression connectors with traditional card edge and pin-in-socket connectors, because of the higher costs associated with the flex based compression connectors. Traditional connectors require a significant force to insert or withdraw the connectors, but require little force to maintain the connection. On the other hand, flex based compression connectors require little force to insert or withdraw the connectors, but require a significant force to maintain the connection. In addition, flex based compression connectors allow little deviation in the position of the connectors with respect to the corresponding connectors on the motherboard. Accordingly, these systems require a sufficient force to insert or withdraw the connectors, proper alignment between the connectors and the corresponding connectors on the motherboard, and finally sufficient force to maintain the connection.

SUMMARY OF THE INVENTION

The present invention is directed to an integral actuator for a printed circuit board. The actuator provides a customer the ability to mount a printed circuit board onto an external device, such as a motherboard, from outside the printed circuit board. The customer simply pushes a handle of the actuator to mount the printed circuit board, or pulls the handle to dismount the printed circuit board.

The actuator includes a platform for fixedly attaching the actuator to the printed circuit board. It includes a plunger slidably mounted to the platform. It also includes a cam mounted to the plunger for engaging the printed circuit board with the external device.

In a preferred embodiment, an actuator structure is provided that mounts to the back of the printed circuit board. In an alternative embodiment, an actuator structure is provided that mounts to the front of the printed circuit board, in a suspended position over the circuit components.

The cam is slidably and rotatably mounted to the plunger. Preferably, both parts are made of stainless steel. A thin aluminum rivet connects the cam and the plunger. Preferably, a protective washer is placed between the rivet and the plunger to prevent the rivet from being worn down. The top of the rivet extends above the plunger no further than the platform extends above the plunger, to keep the actuator uniformly thin.

One or more threaded standoff and screw combinations affix the actuator to the printed circuit board. The threaded standoffs are slidably mounted to the plunger. The platform, which is preferably made of steel coated with zinc, is mounted to the plunger by one or more rivets. The rivets have shoulders which allow the plunger to slide freely with respect to the platform. Protective washers are placed between each rivet and the plunger to prevent the rivets from being worn down. The rivets are slidably mounted to the plunger such that a top of each rivet extends above the plunger no further than the cam extends above the plunger, to keep the actuator uniformly thin.

In a preferred embodiment, the plunger has an offset bend running along its length. The offset bend divides the plunger into a first portion, where the cam is mounted to the plunger, and a second portion, where the platform is mounted to the plunger. The first portion has a lower height than the second portion, with the cam mounting above it. The platform mounts below the second portion. In this manner, the thickness of the actuator is minimized.

A non-conductive handle is attached to the plunger at an end opposite to where the cam is mounted to it. An adhesive in combination with protrusions from the material of the handle are used to adhere the handle to the plunger.

A printed circuit board assembly using the inventive actuator is also provided. The assembly includes a bulkhead assembly, which provides an interface for a customer. The handle extends through a portion of the bulkhead assembly, so that the customer can effect mounting or dismounting of the printed circuit board, on or from the external device, without touching the circuit components of the printed circuit board.

The cam engages a post on a bracket mounted to the external device. Rotation of the cam, which occurs when the customer pushes the plunger handle, forces pins enclosed in a pin connector outward and into the external device. In a preferred embodiment, the cam engages a cam shaft connector, which in turn engages a second cam. The second cam engages a second post on the same bracket. The cam and the second cam are respectively positioned on opposite sides of the printed circuit board.

FEATURES AND ADVANTAGES

The present invention provides a number of important features and advantages. The following is a brief listing of some of them.

The present invention permits a customer to remotely mount or dismount a printed circuit board, such as an I/O board, to an external device, such as a motherboard of a computer. The inventive actuator provides an electrical connection with the external device, in addition to a physical locking with the external device. The customer need not have contact with the circuit components attached to the printed circuit board.

The present invention takes up a minimum amount of space. The working parts are pieces of thin, flat, rigid metal, held together by rivets. The division of the plunger into two portions, including a first portion for mounting the cam, and a second portion for mounting the platform, is used to minimize the total thickness of the inventive actuator. This maximizes space on the circuit board for components and for the free movement of cooling air.

In the present invention, a non-conductive handle is the only portion of the actuator that penetrates the bulkhead assembly. This prevents the dispersion of static electricity (from a customer) onto the circuit components within the bulkhead, and also prevents electromagnetic radiation from being emitted outside of the bulkhead. The reason is because the handle permits a customer to actuate the plunger without extending the plunger outside of the bulkhead.

The present invention permits the customer to choose where to mount the actuator, by providing two actuator structures. One structure (the preferred embodiment) mounts to the back of the printed circuit board. The other structure (an alternative embodiment) mounts to the front of the printed circuit board.

Further features and advantages of the invention, as well as the structure and operation of various embodiments of the invention, are described in detail below with reference to the accompanying drawings.

BRIEF DESCRIPTION OF THE FIGURES

The present invention will be described with reference to the accompanying figures, wherein.

In the figures, like reference numbers generally indicate identical, functionally similar, and/or structurally similar elements. The figure in which an element first appears is indicated by the leftmost digit(s) in the reference number.

DETAILED DESCRIPTION OF THE PREFERRED EMBODIMENTS

1. Listing of the elements

The following section provides a listing of the elements as depicted by the figures. How the elements interrelate in the present invention is described in the sections below.

Figure 1A:
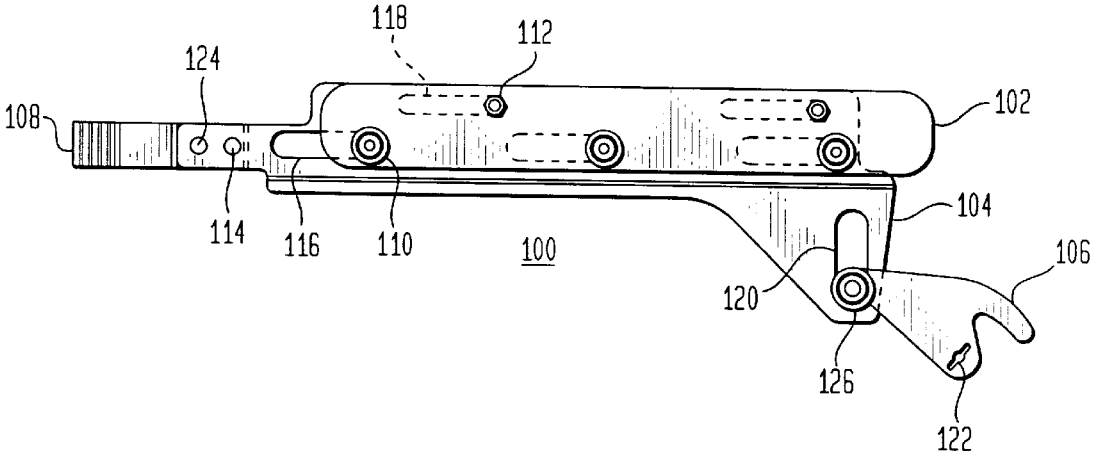
FIGS. 1A, 1B and 1C illustrate a preferred embodiment of the inventive integral actuator from side, isometric perspective and exploded views, respectively.
Figure 1B:
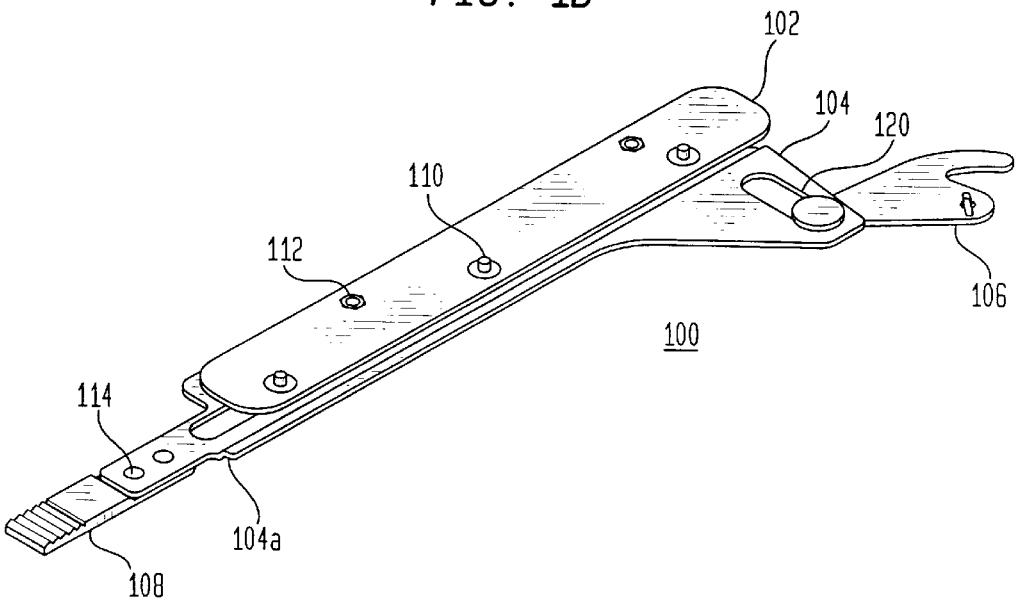
Figure 1C:
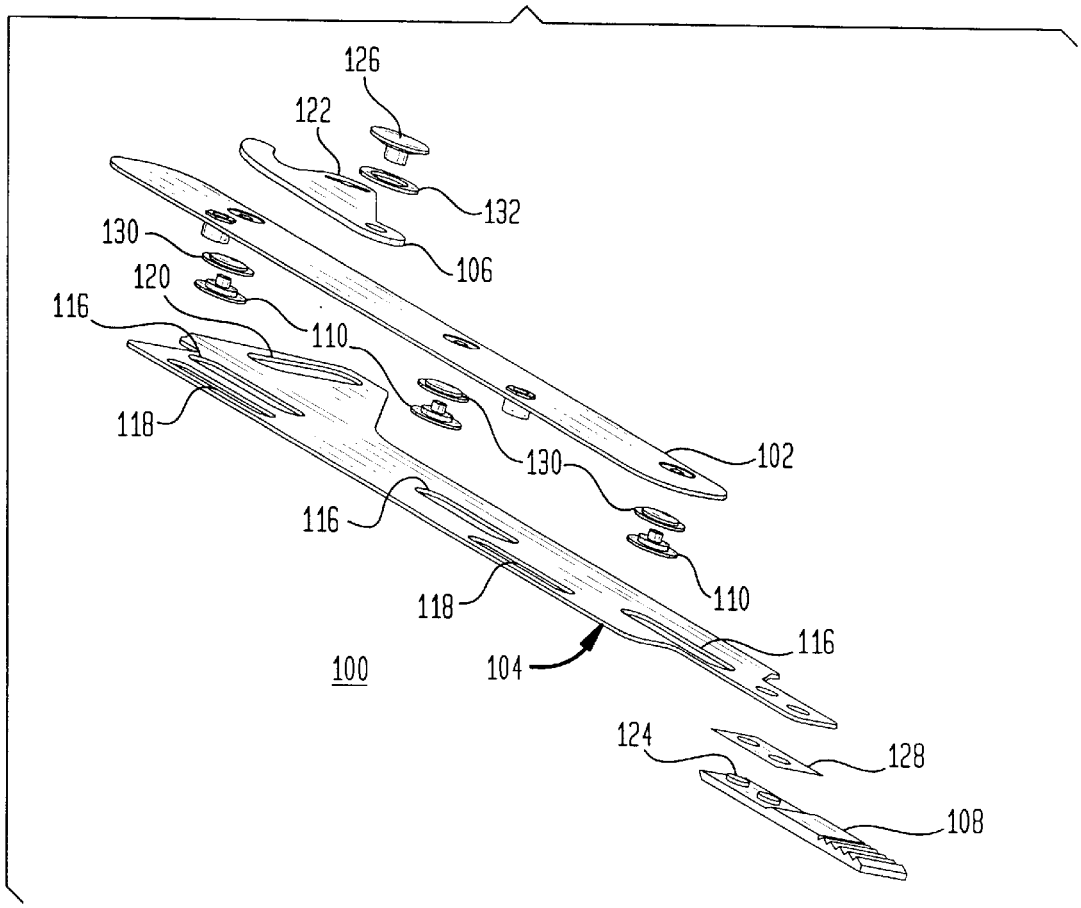

(a) Elements for FIGS. 1A, 1B and 1C:

(i) 100 integral actuator, preferred embodiment (ii) 102 platform (iii) 104 plunger
  (1) 104*a* offsetbend (iv) 106 cam (v) 108 non-conductive handle (vi) 110 rivets (vii) 112 platform mounting threaded standoffs and screws (viii) 114 handle openings (ix) 116 sliding openings for rivets 110

(x) 118 sliding openings for platform mounting threaded standoffs and screws 112

(xi) 120 sliding opening for rivet 126

Figure 2:
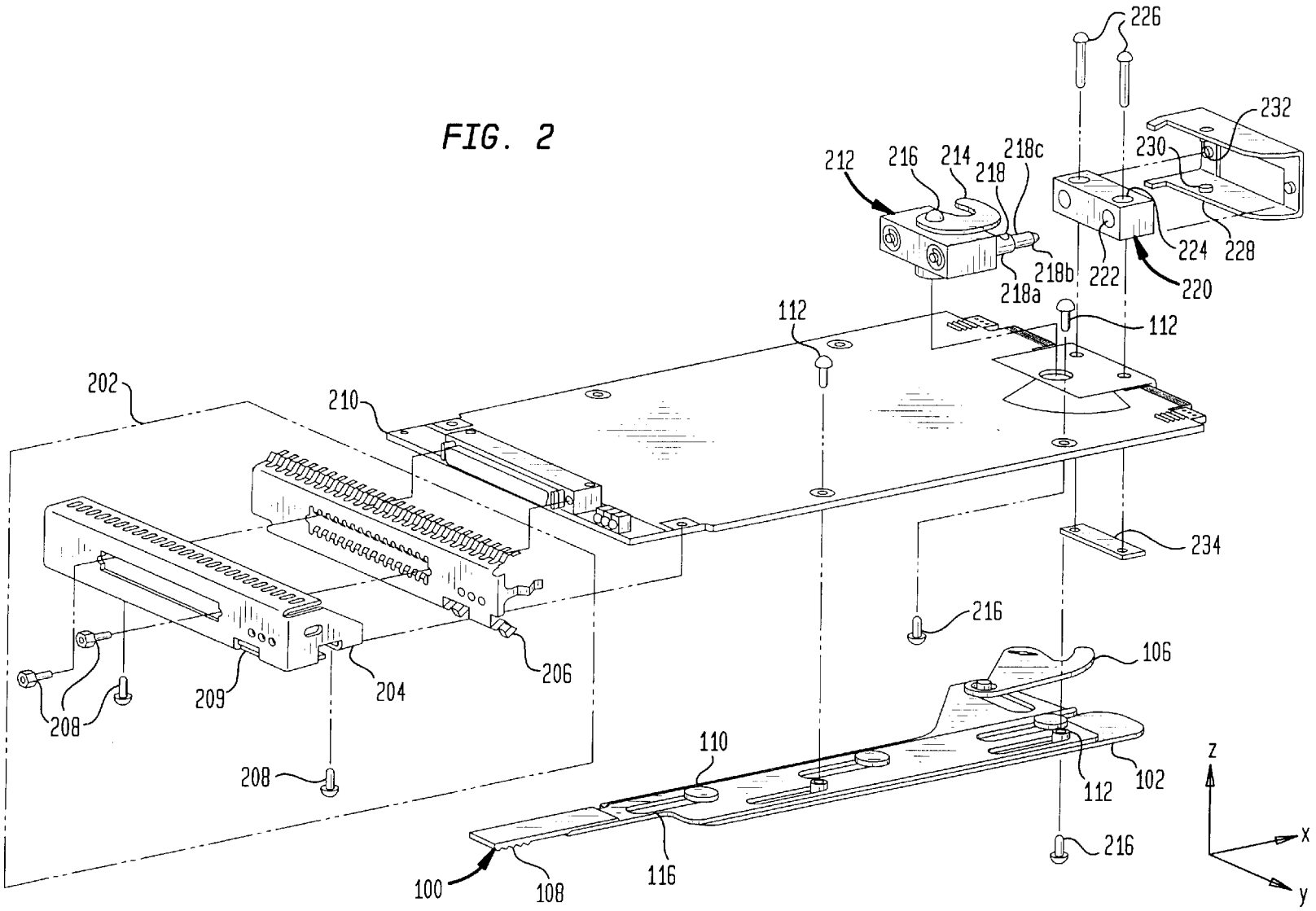
FIG. 2 is an exploded view of a printed circuit board assembly that includes the actuator of the preferred embodiment.
Figure 3A:
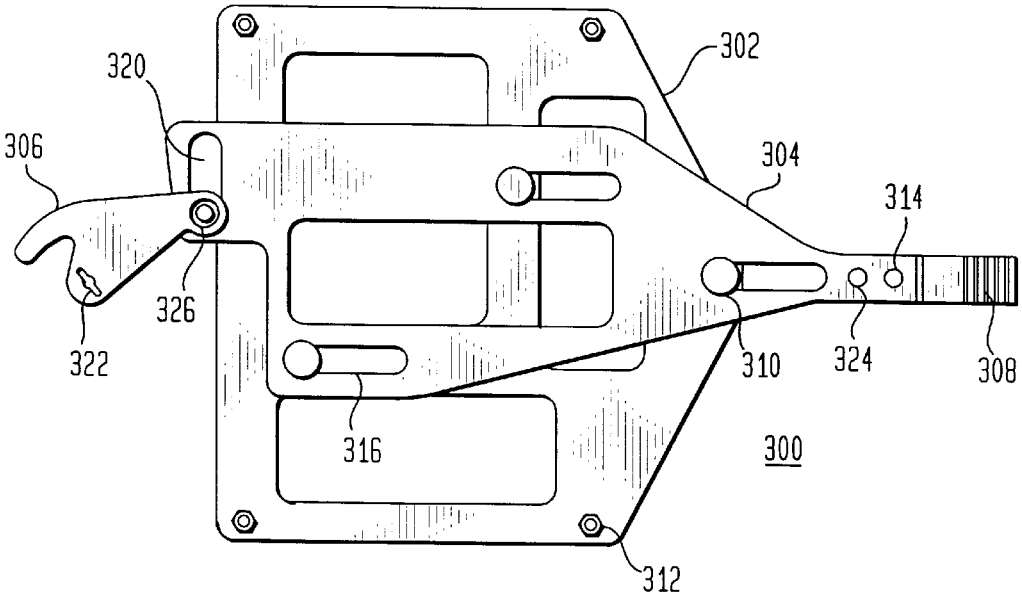
FIGS. 3A and 3B illustrate an alternative embodiment of the inventive integral actuator from side and exploded views, respectively.
Figure 3B:
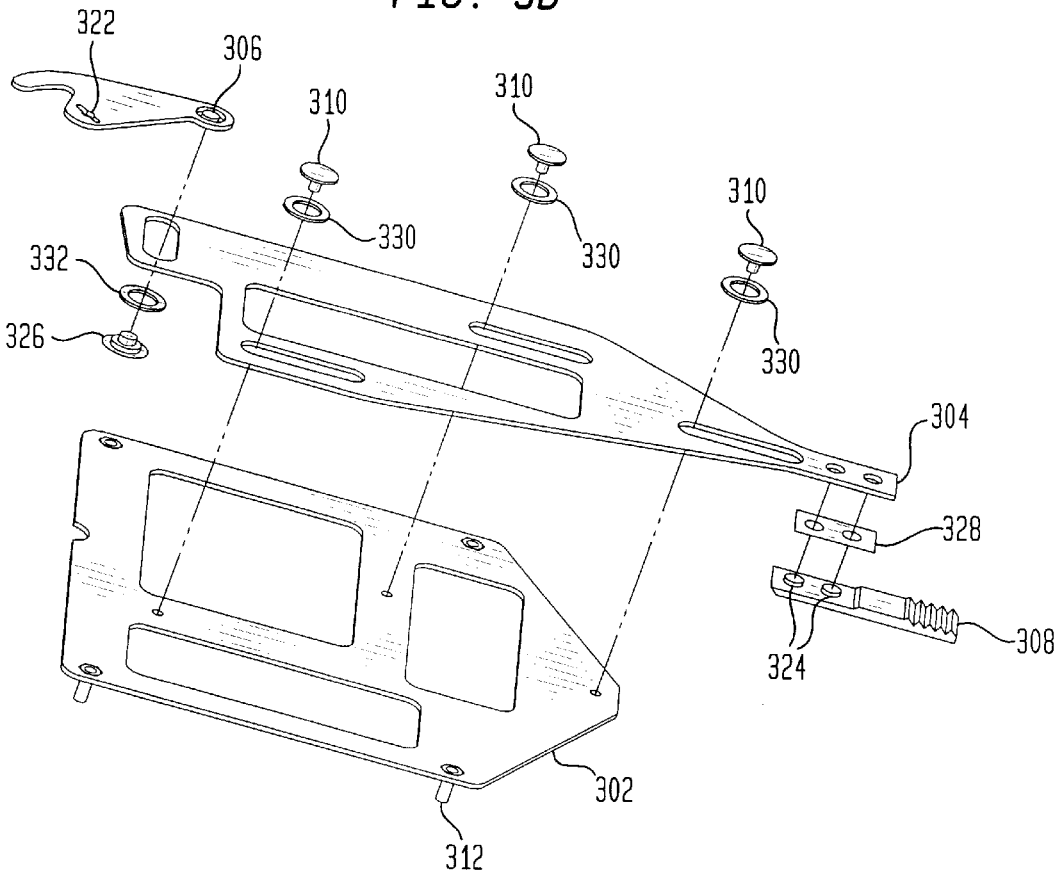

(xii) 122 cam shaft opening (xiii) 124 handle protrusions (xiv) 126 rivet (xv) 128 adhesive (xvi) 130 washer (xvii) 132 washer (b) Elements for FIG. 2:

(i) 202 bulkhead assembly (ii) 204 bulkhead (iii) 206 bulkhead shield (iv) 208 bulkhead screws (v) 209 bulkhead actuator slot (vi) 210 printed circuit board (vii) 212 compression connector mechanical block (viii) 214 secondary cam (ix) 216 cam shaft (x) 218 guidepins
  (1) 218*a* guide pin openings
  (2) 218*b* guide pin protrusions
  (3) 218*c* guide pin stop faces (xi) 220 compression connector main block (xii) 222 axial openings of compression connector main block (xiii) 224 vertical openings of compression connector main block (xiv) 226 screws (xv) 228 backplate hook (xvi) 230 first post of backplate hook (xvii) 232 second post of backplate hook (xviii) 234 backing plate (c) Elements for FIGS. 3A and 3B:

(i) 300 integral actuator, alternative embodiment (ii) 302 platform (iii) 304 plunger (iv) 306 cam (v) 308 non-conductive handle (vi) 310 rivets (vii) 312 platform mounting threaded standoffs and screws (viii) 314 handle openings (ix) 316 sliding openings for rivets 310

(x) 320 sliding opening for rivet 326

Figure 4:
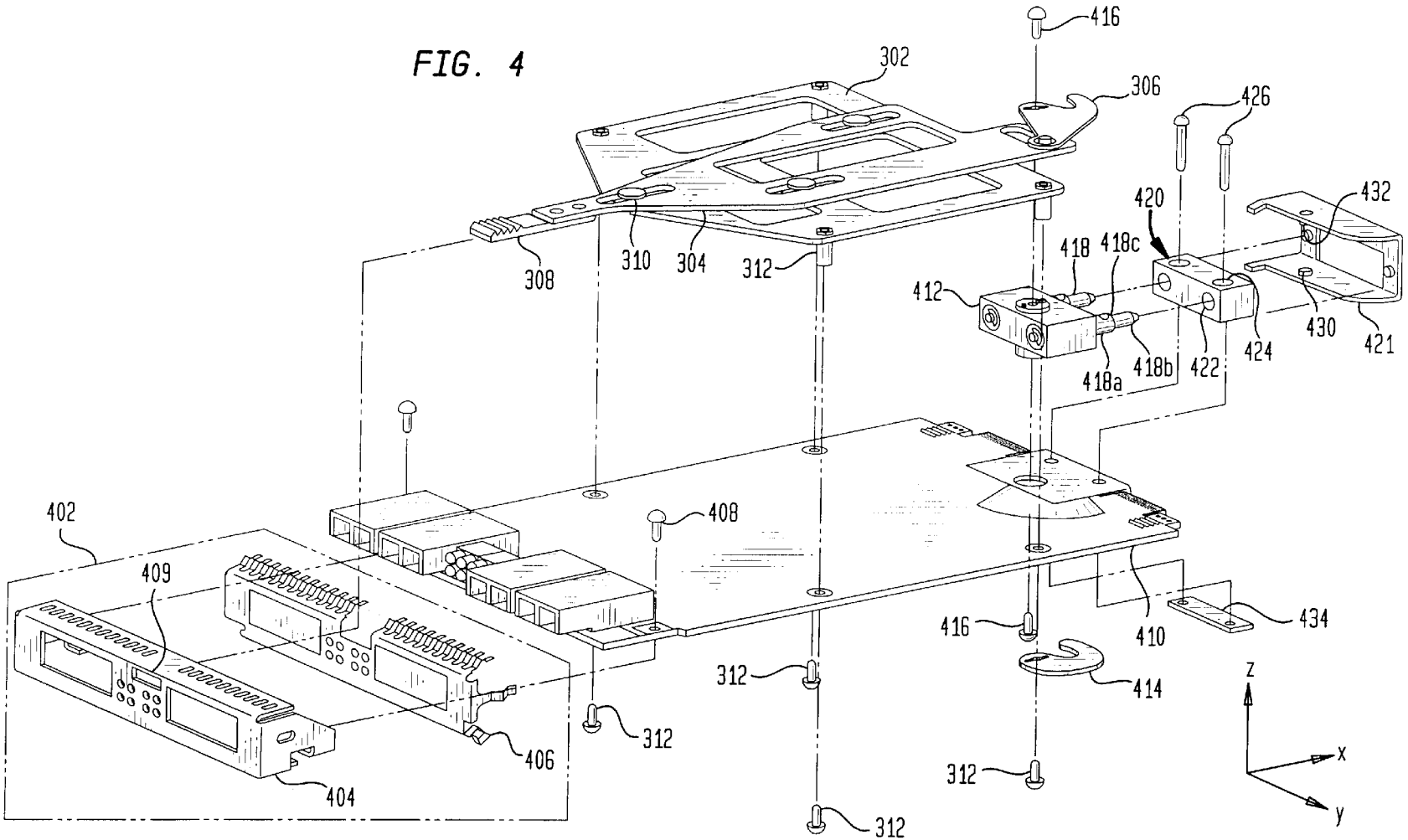
FIG. 4 is an exploded view of a printed circuit board assembly that includes the actuator of the alternative embodiment.

(xi) 322 cam shaft opening (xii) 324 handle protrusions (xiii) 326 rivet (xiv) 328 adhesive (xv) 330 washer (xvi) 332 washer (d) Elements for FIG. 4:

(i) 402 bulkhead assembly (ii) 404 bulkhead (iii) 406 bulkhead shield (iv) 408 bulkhead screws (v) 409 bulkhead actuator slot (vi) 410 printed circuit board (vii) 412 compression connector mechanical block (viii) 414 secondary cam (ix) 416 cam shaft (x) 418 guide pins (1) 418*a* guide pin openings (2) 418*b* guide pin protrusions (3) 418*c* guide pin stop faces (xi) 420 compression connector main block (xii) 422 axial openings of compression connector main block (xiii) 424 vertical openings of compression connector main block (xiv) 426 screws (xv) 428 backplate hook (xvi) 430 first post of backplate hook (xvii) 432 second post of backplate hook (xviii) 434 backing plate 2. The inventive device The present invention will be described herein as an integral actuator for a printed circuit board. The actuator effects connection between the printed circuit board and an external device, such as a motherboard. In a preferred embodiment, the inventive device effects a clamping connection between an Origin2000 or Onyx2 family of Xtalk IO cards, produced by Silicon Graphics Corporation, and a motherboard. In the preferred embodiment, the IO card establishes electrical connection with a 96 pin compression pad on pad (CPOP) connector, produced by IBM Corporation. However, it is to be understood that the description is exemplary in nature, and that the present invention can readily be used on devices other than IO cards, or even generic printed circuit boards.

(a) The preferred embodiment

FIGS. 1A and 1B illustrate the preferred embodiment of the inventive integral actuator. Both figures illustrate the same side of integral actuator 100. Actuator 100 is preferably used to remotely connect a printed circuit board to an external device. An example of such an external device is a motherboard of a computer. Actuator 100 locks the printed circuit board into place with the motherboard. Simultaneously, actuator 100 forces connector pins in the printed circuit board to penetrate a corresponding connector on the motherboard, to effect an electrical connection between the printed circuit board and the motherboard.

The inventive actuator 100 principally comprises three parts: a platform 102, a plunger 104, and a cam 106. All three pieces are thin and flat in shape, preferably made of a rigid, sheet-like metal. In a preferred embodiment, plunger 104 and cam 106 are made of stainless steel, while platform 102 is made of steel coated with zinc. However, the invention is not limited to this preferred implementation. Other suitable materials will be apparent to persons skilled in the relevant art(s).

Platform 102 is fixedly attached to a printed circuit board by platform mounting threaded standoffs and screws 112. Specifically, platform mounting threaded standoffs 112 are permanently and fixedly mounted to platform 102, and platform mounting screws 112 permit a fixed attachment of the entire integral actuator 100 to a printed circuit board. The platform mounting threaded standoffs and screws 112 are illustrated below in FIG. 2. Sliding openings 118 permit plunger 104 to slide back and forth relative to platform 102. FIG. 1A shows the side of platform 102 that will attach to the printed circuit board.

Plunger 104 is slidably mounted to platform 102 by rivets 110. In a preferred embodiment, rivets 110 are made of aluminum. Rivets 110 are affixed directly to platform 102. Sliding openings 116 permit plunger 104 to slide back and forth relative to platform 102. FIGS. 1A and 1B show the back of rivets 110.

A cam 106 is both rotatably and slidably mounted to plunger 104 by rivet 126. Cam 106 has a cam shaft opening 122. In a preferred embodiment, rivet 126 is similarly made of aluminum. Rivet 126 is affixed directly to cam 106. Sliding opening 120 permits cam 106 to slide back and forth relative to plunger 104. FIGS. 1A and 1B show the top of rivet 126.

A non-conductive handle 108 is fixedly attached to plunger 104. Handle 108 has ridges that provide a user a better grip. The ridges are provided on the top surface of handle 108, at the distal end of handle 108 away from plunger 104. At the end of handle 108 proximate to plunger 104, handle 108 has two handle protrusions 124. Handle protrusions 124 align handle 108 to plunger 104 by protruding into handle openings 114. In a preferred embodiment, handle protrusions 124 do not extend beyond the thickness of plunger 104.

FIG. 1C is an exploded view of the inventive integral actuator 100. This exploded view illustrates some features not readily apparent from FIGS. 1A and 1B. An adhesive 128 is applied to the surface of plunger 104 between plunger 104 and handle 108. In a preferred embodiment, adhesive 128 is an acrylic film adhesive, designed for permanent, high-strength applications. As an example, one or more of such acrylic film adhesives are designed by the 3M Corporation. Adhesive 128 need only withstand forces in the peeling direction (i.e., the direction orthogonal to the plane of plunger 104). This is because handle protrusions 124 can withstand forces in the direction in which plunger 104 slides with respect to platform 102.

The exploded view of FIG. 1C shows washers 130, which are placed between rivets 110 and plunger 104, before the rivets 110 have been attached onto platform 102. The placing of rivets 110 can occur as follows. Rivets 110 are passed through washers 130, sliding openings 116 (on the plunger) and small holes (not shown) in the platform 102. A rivet placement tool is used to mold (i.e., swage) the portion of rivets 110 extending beyond platform 102. Because rivets 110 are made of a softer metal than the material of the plunger 104, the washers 130 are needed to prevent the grinding away of the softer metal of rivets 110 and also to significantly lower the friction between the rivets 110 and the plunger 104. In a preferred embodiment, washers 130 are made of a slippery plastic material. For example, the washers 130 can be made of an acetyl plastic material.

The exploded view of FIG. 1C also shows washers 132, which are placed between rivet 126 and plunger 104, before rivet 126 has been attached onto cam 106. The placing of rivet 126 can occur as follows. Rivet 126 is passed through washer 132, sliding opening 120 (on the plunger) and a small hole (not shown) in the cam 106. A rivet placement tool is used to mold the portion of rivet 126 extending beyond cam 106. Because rivet 106 is made of a softer metal than the material of the plunger 104, the washer 132 is needed to prevent the grinding away of the softer metal of the rivet 126. In a preferred embodiment, like washers 130, washer 132 is made of a slippery plastic material, such as an acetyl plastic.

In a preferred embodiment, plunger 104 also has an offset bend 104*a* Offset bend 104*a* divides plunger 104 into two portions. The first portion interfaces with cam 106 and includes sliding opening 120. The second portion interfaces with platform 102 and includes sliding openings 116 (for the rivets 110) and sliding openings 118 (for the platform mounting threaded standoffs 112). The difference in height between the portions provides a recess wherein platform 102 fits. Preferably, actuator 100 is designed such that rivet 126 protrudes above the first portion to a height equal to the height of platform 102 above the second portion. Similarly, on the opposite side of actuator 100, rivets 130 protrude above the second portion to a height equal to the height of cam 106 above the first portion. The offset bend 104*a* also renders the plunger 104 very stiff in the pushing/pulling direction.

FIG. 2 is an exploded view of the inventive printed circuit board assembly, which is the system wherein the inventive integral actuator 100 functions. FIG. 2 principally includes bulkhead assembly 202, printed circuit board 210, compression connector mechanical block 212, compression connector main block 220, backplate hook 228 (i.e., a type of bracket), and the inventive integral actuator 100. A three dimensional axis is also provided, showing an x-axis in the direction of the length of the printed circuit board 210, ay-axis in the direction of the width of the printed circuit board 210, and a z-axis in the direction toward the top of the printed circuit board 210.

The bulkhead assembly 202 is the only portion of the system to which a user has access. Bulkhead assembly 202 includes bulkhead 204, bulkhead shield 206, and bulkhead screws 208. Specifically, the user has access to bulkhead 204. Bulkhead shield 206 serves as an emi shield, keeping electromagnetic energy inside bulkhead 204. Bulkhead screws 208 are used to mount bulkhead 204 and bulkhead shield 206 to the printed circuit board 210. Bulkhead 204 (and bulkhead shield 206) include a bulkhead actuator slot 209.

Handle 108 of the inventive integral actuator 100 protrudes through bulkhead actuator slot 209, outside of bulkhead 204. In a preferred embodiment, it is important that the portion of plunger 104 to which non-conductive handle 108 is attached not protrude outside of the bulkhead 204. A user, who may touch handle 108, carries static electricity. If the plunger 104, which is made of metal, protrudes outside bulkhead 204, then this static electricity will be passed onto the circuit components of the printed circuit board 210. However, if only the non-conductive handle 108 protrudes beyond bulkhead 204, then the static electricity will dissipate onto the bulkhead assembly 202, which cannot harm the circuit components.

In addition, electromagnetic energy emitted from the printed circuit board 210 is captured by the metal of the actuator 100. If the plunger 104 extends beyond the bulkhead 204, then it will function as an antenna, radiating electromagnetic energy outside the bulkhead 204. Keeping the plunger 104 inside bulkhead assembly 202 prevents this external radiation problem.

Integral actuator 100 mounts to printed circuit board 210 on its back side. The top side of the printed circuit board 210 (in the +z-direction) is where circuit components are attached, whereas the back side (in the −z-direction) is the opposite side of the circuit components. Platform mounting threaded standoffs and screws 112 attach platform 102 to printed circuit board 210. Specifically, platform mounting threaded standoffs 112 are permanently and fixedly mounted to platform 102, and platform mounting screws 112 permit a fixed attachment of the platform 102 to the printed circuit board 210. In one embodiment, there are additional washers between printed circuit board 210 and the platform mounting threaded standoffs 112, which are affixed to platform 102.

A cam shaft 216 protrudes through printed circuit board 210 and compression connector mechanical block 212. In a preferred embodiment, cam shaft 216 comprises two screws and a center cam shaft. The center cam shaft resides inside of mechanical block 212, between cam 106 and secondary cam 214. The top screw screws into the center cam shaft from the top to attach secondary cam 214. Similarly, the bottom screw screws into the center cam shaft from the bottom to attach cam 106 via cam shaft opening 122. In this manner, cam shaft 216 connects cam 106 with secondary cam 214. Secondary cam 214 is rotatably mounted to mechanical block 212 by cam shaft 216. One embodiment of compression connector mechanical block 212 and main block 220 is provided in the U.S. Patent Application entitled "Compression Connector", which was listed above.

Backplate hook 228 is a bracket that is fixedly attached to a motherboard. In a preferred embodiment, backplate hook 228 is attached to the motherboard by screws (not shown) connecting backplate hook 228 to a backing plate (not shown) on the opposite side of the motherboard. Backplate hook 228 includes a first post 230 and a second post 232. First post 230 engages with secondary cam 214. Likewise, second post 232 engages with cam 106.

Compression connector main block 220 is securely attached to printed circuit board 210 by screws 226. Screws 226 pass through axial openings 224 of main block 220, through openings 218*a* in guide pins 218, through openings in printed circuit board 210, and into threaded openings in backing plate 234.

Main block 220 is connected to mechanical block 212 by guide pins 218. Guide pin openings 218*a* accommodate screws 226, such that guide pin protrusions 218*b* can move freely (within a narrow range) within axial openings 222 of main block 220.

The thickened middle portion of guide pins 218, which have guide pin openings 218*a*, have stop faces in the +x and −x directions. In the +x direction, stop faces 218*c* act as a contact surface with main block 220. In the −x direction, opposite stop faces (not shown) act as a contact surface with helically shaped springs (not shown). Each guide pin 218 passes through a spring and into openings in mechanical block 212. Therefore, the springs contact these opposite stop faces on the guide pins and a surface of mechanical block 212 in the +x direction.

Guide pins 218 pass through mechanical block 212. At the end, a retainer ring and washer assembly is used to attach the guide pins 218 to the mechanical block 212.

Electrical coupling between the printed circuit board 210 and the motherboard is effected by main block 220. In one embodiment, main block 220 is a CPOP connector. Main block 220 has a flex circuit (not shown) covering its surface that interfaces with printed circuit board 210 (in the −z direction) and also covering its surface that interfaces with the motherboard (in the +x direction). The flex circuit includes arrays of contact pads on these same surfaces. Electrical connection with the motherboard is effected by contact between the array of contact pads on the flex circuit of main block 220 in the +x direction and a corresponding array of contact pads on the motherboard. Electrical connection with the printed circuit board 210 is effected by contact between the array of contact pads on the flex circuit of main block 220 in the −z direction and a corresponding array of contact pads on the printed circuit board 210.

(b) An alternative embodiment

FIGS. 3A and 3B illustrate an alternative embodiment of the inventive integral actuator 300. Both figures illustrate the same side of integral actuator 300. The elements of these figures are designated in a manner to identify which elements in FIGS. 1A–1C they correspond with. Specifically, the right-most digits are used to identify the elements. For example, rivet 326 for cam 306 in FIGS. 3A, 3B corresponds to rivet 106 for cam 106 in FIGS. 1A–1C.

For the most part, actuator 300 is identical to actuator 100. The exceptions are listed below.

The difference between how actuator 300 and how actuator 100 are respectively implemented contributes to their respective structures. Whereas actuator 100 is mountable to the back of a printed circuit board, actuator 300 is mountable to the front of a printed circuit board.

Accordingly, the platform mounting threaded standoffs 312 are longer than the corresponding platform mounting threaded standoffs 112. The longer platform mounting threaded standoffs 312 are required to suspend actuator 300 at a higher elevation, to leave room for the circuit components mounted on the printed circuit board.

The inventive printed circuit board assembly that uses actuator 300 is shown in FIG. 4, in exploded view. The elements of FIG. 4 are designated in a manner to identify which elements in FIG. 2 they correspond with. Again, the right-most digits are used to identify the elements. For example, bulkhead 404 of bulkhead assembly 402 in FIG. 4 corresponds to bulkhead 204 of bulkhead assembly 202 in FIG. 2. The differences between FIG. 2 and FIG. 4 are provided below.

The higher elevation at which actuator 300 is mounted potentially makes the actuator assembly less stable. Accordingly, plunger 304 and platform 302 are wider than plunger 104 and platform 102. Platform 304 has two platform mounting threaded standoffs and screws 312 for mounting it on one side of printed circuit board 410, and an additional two platform mounting threaded standoffs and screws 312 for mounting it to the other side of printed circuit board 410. This structure allows unrestricted component placement on the printed circuit board.

In another embodiment that is not shown, platform 304 has a total of three platform mounting threaded standoffs and screws 312, two platform mounting threaded standoffs and screws 312 for mounting it to one side of printed circuit board 410, and one platform mounting threaded standoff and screw 312 for mounting it to the other side of printed circuit board 410. The actuator of this embodiment lacks one of the portions of platform 302, preferably a portion located nearest cam 306.

The printed circuit board assembly of FIG. 4 is different from that of FIG. 2 with respect to the positioning of cam 306 and secondary cam 414. Here, it is cam 306 that is positioned over compressing system 412, not secondary cam 414. Accordingly, cam 306 engages first post 430, whereas secondary cam 414 engages second post 432. This is the reverse of how cam 106 and secondary cam 214 engage with second and first posts 232 and 230, respectively.

3. The inventive method (a) The preferred embodiment

The following is a description of how the inventive integral actuator functions in the preferred embodiment.

(i) Engagement

The following is an explanation of how printed circuit board 210 is engaged into a locking position with the motherboard. As noted, non-conductive handle 108 protrudes through bulkhead actuator slot 209 of bulkhead 204. When a user presses handle 108, plunger 104 slides in the +x-direction, while printed circuit board 210 and platform 102 remain stationary.

Cam shaft 216, which connects cam 106 to secondary cam 214, prevents cam 106 from moving in the +x-direction. Accordingly, the motion of plunger 104 makes cam 106 rotate in a counter-clockwise direction (as viewed from the top of the printed circuit board). It also makes the base of cam 106 (attached to rivet 126) slide in the +y-direction, within sliding opening 120.

As noted, cam 106 is connected to secondary cam 214 by cam shaft 216. Because of this connection, the motion of cam 106 similarly causes a counterclockwise rotation of secondary cam 214 with respect to mechanical block 212.

As cam 106 rotates it engages post 230. Similarly, as secondary cam 214 rotates, it engages post 232. The engagement of the cams with the posts forces main block 220 and mechanical block 212 toward the motherboard, so that these compression connector parts are securely fastened with backplate hook 228. Here, the cams rotate until they reach a locked position. In the locked, position, the shape of the cams prevents the cams from rotating any further. In addition, after locking, the shape of the cams prevents the cams from rotating in the reverse direction (i.e., the clockwise direction as viewed from the top), unless handle 108 is pulled out.

The locking also brings the mechanical block 212 closer to the main block 220. This compresses the springs on guide pins 218 between the stop faces in the −x direction and mechanical block 212.

When locking occurs, an electrical connection is also established with the motherboard. When the cams rotate into locked position, the array of contact pads protruding from the flex circuit of main block 220 in the +x direction are pressed onto the array of corresponding contact pads in the motherboard. Because uniform pressure is applied to main block 220 and mechanical block 221, uniform contact is established between these corresponding arrays of contact pads.

(ii) Disengagement

The following is an explanation of how printed circuit board 210 is disengaged from a locking position with the motherboard. Essentially, the method for disengagement of actuator 300 occurs in a reverse manner to the method for engagement. When a user pulls handle 108, plunger 104 slides in the −x direction. Accordingly, the base of cam 106 slides in the −y direction, within sliding opening 120. Cam 106 rotates in the clockwise direction.

Because of the connection between cam 106 and secondary cam 214, via cam shaft 216, secondary cam 214 also rotates in the clockwise direction. The movement of cam 106 and secondary cam 214 disengages them from second and first posts 230 and 232, respectively. This releases main block 220 and mechanical block 212 from the motherboard. The release permits the springs on guide pins 218 to expand, which pulls main block 220 and mechanical block 212 from the motherboard. The springs also pull main block 220 and mechanical block 212 away from one another.

The release of lock also disengages the electrical connection between printed circuit board 210 and the motherboard. The array of contact pads protruding from the flex circuit of main block 220 in the +x direction are pulled away from the array of corresponding contact pads in the motherboard.

(b) The alternative embodiment

The inventive method for the alternative embodiment is almost identical to the inventive method for the preferred embodiment. The primary difference between the two methods stems from the fact that in the alternative method, actuator 300 is mounted on the front of printed circuit board 410, instead of on the back. Accordingly, the methods are identical except that cam 306 is mounted over compressing system 412 and engages first post 430, whereas secondary cam 414 is positioned below printed circuit board 410 and engages second post 432.

4. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. An actuator mountable to a printed circuit board for connecting the printed circuit board to an external device from a remote position, the actuator comprising:

a platform fixedly attaching the actuator to the printed circuit board;

a plunger slidably mounted to said platform, wherein said plunger is biased in a first direction by a user to attach said printed circuit board onto the external device and wherein said plunger is biased in a second direction by a user to detach said printed circuit board from the external device; and a cam mounted to said plunger engaging the printed circuit board with the external device.

2. An actuator according to claim 1, wherein the external device is a motherboard.

3. An actuator according to claim 1, wherein the printed circuit board is an input/output board.

4. An actuator according to claim 1, wherein the actuator is mountable to the back of the printed circuit board.

5. An actuator according to claim 1, wherein the actuator is mountable to the front of the printed circuit board.

6. An actuator according to claim 5, further comprising:

one or more threaded standoff and screw combinations for fixedly attaching the platform to the printed circuit board, said one or more threaded standoff and screw combinations each having threaded standoffs for raising the actuator above circuit components mounted on the printed circuit board.

7. An actuator according to claim 1, wherein said cam is slidably mounted to said plunger.

8. An actuator according to claim 7, wherein said cam is rotatably mounted to said plunger.

9. An actuator according to claim 1, wherein said cam is made of stainless steel.

10. An actuator according to claim 1, wherein said cam is mounted to said plunger by a rivet.

11. An actuator according to claim 10, further comprising:

a protective washer placed between said plunger and said rivet for reducing friction therebetween.

12. An actuator according to claim 10, wherein said rivet is slidably mounted to said plunger such that a top of said rivet extends above said plunger no further than said platform extends above said plunger.

13. An actuator according to claim 1, wherein said platform is made of steel coated with zinc.

14. An actuator according to claim 1, further comprising:

one or more screws for fixedly attaching the actuator to the printed circuit board.

15. An actuator according to claim 14, wherein said one or more screws are slidably mounted to said plunger.

16. An actuator according to claim 1, wherein said platform is mounted to said plunger by one or more rivets.

17. An actuator according to claim 16, further comprising:

one or more protective washers, each said protective washer placed between a said rivet and said plunger for reducing friction therebetween.

18. An actuator according to claim 16, wherein said one or more rivets are mounted to said plunger such that a top of each said rivet extends above said plunger no further than said cam extends above said plunger.

19. An actuator according to claim 1, wherein said platform is made of steel coated with zinc.

20. An actuator according to claim 1, wherein said plunger has an offset bend running along its length for dividing said plunger into a first portion, wherein said cam is mounted to said plunger, and a second portion, wherein said platform is mounted to said plunger.

21. An actuator according to claim 20, wherein said first portion of said plunger has a lower height than said second portion of said plunger, wherein said cam mounts above said first portion of said plunger, and wherein said platform mounts below said second portion of said plunger.

22. An actuator according to claim 1, further comprising:

a non-conductive handle attached to said plunger at an end opposite to where said cam is mounted to said plunger.

23. An actuator according to claim 1, wherein further comprising:

an adhesive placed between said non-conductive handle and said plunger for providing adhesion therebetween.

24. A printed circuit board assembly mountable to an external device, said printed circuit board assembly comprising:

a printed circuit board;

an actuator mountable to said printed circuit board for connecting said printed circuit board to the external device from a remote position, the actuator comprising:

a platform fixedly attaching the actuator to the printed circuit board;

a plunger slidably mounted to said platform, wherein said plunger is biased in a first direction by a user to attach said printed circuit board onto the external device and wherein said plunger is biased in a second direction by a user to detach said printed circuit board from the external device;

a cam mounted to said plunger engaging the printed circuit board with the external device.

25. A printed circuit board assembly according to claim 24, wherein said cam engages a post on a bracket mounted to the external device.

26. A printed circuit board assembly according to claim 25, wherein a rotation of said cam forces pins enclosed in a pin connector outward therefrom, which in turn forces said pins into said external device.

27. A printed circuit board assembly according to claim 25, wherein said cam engages a cam shaft, which in turn engages a second cam.

28. A printed circuit board assembly according to claim 27, wherein said second cam engages a second post on said bracket.

29. A printed circuit board assembly according to claim 27, wherein said cam and said second cam are respectively positioned on opposite sides of said printed circuit board.

30. A printed circuit board assembly according to claim 25, further comprising:

a bulkhead assembly for providing an interface for a user;

a non-conductive handle attached to said plunger at an end opposite to where said cam is mounted to said plunger, wherein said non-conductive handle extends through a portion of said bulkhead assembly.

* * * * *